US007648326B2

(12) United States Patent
Santele et al.

(10) Patent No.: US 7,648,326 B2
(45) Date of Patent: Jan. 19, 2010

(54) ADAPTER FACEPLATE

(76) Inventors: Christopher Santele, 2012 180th Ave., Mora, MN (US) 55051; John Gustafson, 206 S. State St., Fall Creek, WI (US) 54742

( * ) Notice: Subject to any disclaimer, the term of this patent is extended or adjusted under 35 U.S.C. 154(b) by 119 days.

(21) Appl. No.: 11/709,344

(22) Filed: Feb. 21, 2007

(65) Prior Publication Data

US 2008/0199293 A1 Aug. 21, 2008

(51) Int. Cl.
*E02F 3/96* (2006.01)

(52) U.S. Cl. ..... 414/723; 37/468

(58) Field of Classification Search ..... 414/723; 37/468

See application file for complete search history.

(56) References Cited

U.S. PATENT DOCUMENTS 5,403,144 A * 4/1995 Staben, Jr. ..... 414/697
5,938,399 A * 8/1999 Knutson ..... 414/722
6,533,529 B2 * 3/2003 Waggoner ..... 414/723

* cited by examiner

*Primary Examiner*—Donald Underwood
(74) *Attorney, Agent, or Firm*—Jacobson and Jacobson; Thomas N. Phung

(57) ABSTRACT

In combination a vehicle having an extension and an adaptor faceplate. The extension includes a first power-operated extension mount and a second mount. The adaptor faceplate comprising a rigid member securable to skid steer attachments with the rigid member having a front side and a back side with a frame extending from the back side of the rigid member for supporting a first connecting member and a second connecting member thereon with the first connecting member attachable to the first power-operated extension mount and the second connecting member attachable to the second extension mount.

18 Claims, 9 Drawing Sheets

ADAPTER FACEPLATE

CROSS REFERENCE TO RELATED APPLICATIONS

This application claims priority to currently pending U.S. patent application Ser. No. 10/877,272; filed on Jun. 25, 2004 and titled FACEPLATE; U.S. patent application Ser. No. 10/440,649, now U.S. Pat. No. 7,108,475, filed on May 19, 2003 and titled THREE-POINT HITCH FACEPLATE, and U.S. Provisional Application No. 60/437,076, filed Dec. 30, 2002 and titled and titled THREE-POINT HITCH FACEPLATE.

FIELD OF THE INVENTION

This invention relates generally to an apparatus that allows a user to use specialty equipment available for skid steer loaders on an end of extensions such as a power-operated extension, a power-operated boom or a lifting arm of vehicles such as backhoes, tractors and excavators.

STATEMENT REGARDING FEDERALLY SPONSORED RESEARCH OR DEVELOPMENT

None

REFERENCE TO A MICROFICHE APPENDIX

None

BACKGROUND OF THE INVENTION

Skid steer machines are known and widely used for many tasks. The skid steer machines are compact and lack any steerable wheels. In contrast to machines that have steerable wheels the skid steer maneuvers by stopping or slowing the rotation of one set of side wheels while allowing the other set of side wheels to rotate. The skid steer machines are extremely popular for use in special operations. As a result, a number of different attachments have been created to allow the skid steer machine to perform different tasks. For example, in one application a bucket is attached to the front of the skid steer machine and in another application a blade and in still other applications forks can be attached to allow the skid steer machine to be used as a fork loader.

One of the disadvantages of the skid steer machines is that the skid steer machines are relatively expensive and the equipment used with the skid steer machines is specialized. Consequently, the use of skid steer machines and attachments to skid steer machines is limited to specific industries. Since some skid steer activities are of a one time usage there has developed a market for rental of attachments for skid steer loaders.

Excavator loaders, backhoes, tele-booms, and other types of loaders have been in existence for a number of years. Typically, an excavator or a backhoe tractor have been used to power a shovel or scoop specifically designed for that machine for the purpose of digging into the earth or for moving dirt, gravel, sand, or other materials. More recently, tele-booms and telescoping loaders have employed the use of a pallet fork specifically designed for those machines. In the course of working on a job site, it is often necessary to change from one size or type of bucket, or other tool. In these cases, it is necessary to perform the time-consuming and often difficult task drive out the pins in order to release the scoop or shovel, and reverse the process to secure a second implement to the loader arm. In addition, from time to time an owner of vehicles such as the backhoe tractor and excavator may need to perform specific tasks, which could be performed with an available attachment for a skid steer loader.

The present invention provides an adaptor faceplate that mounts to an end of an extensions such as a power-operated extension, power-operated boom or lifting arm of vehicles such as a backhoe tractors or excavators to allows an operator to engage and operate conventional skid steer attachments using the power-operated extension, power-operated boom or lifting arm of the vehicle as a source of power. Some of the benefits of the present invention include the ability to perform tasks that were previously not possible due to the reach capability of vehicles such as the backhoe tractor and excavator while also increasing productivity through the reduction of the time required to complete a project.

SUMMARY OF THE INVENTION

The present invention comprises an adaptor faceplate that allows conventional skid steer attachments to be used on vehicles having extensions such as backhoes and excavator. The present invention also comprises the combination of a vehicle having an extension and an adaptor faceplate. The extension of the vehicles includes a first extension mount and a second extension mount. The adaptor faceplate comprises a rigid member securable to skid steer attachments with the rigid member having a front side and a back side, and a set of connecting members positioned on the back side of the rigid member and are connectable to the extension mounts. The adaptor faceplate also includes a frame extending from the back side of the rigid member for supporting the set of connecting members thereon. The rigid member also includes an angled top lip to form mating engagement with the conventional skid steer attachment and a latch mechanism for securing the skid steer attachments to the rigid member.

DESCRIPTION OF THE PREFERRED EMBODIMENT

Generally, the present invention comprises an adaptor faceplate that allows conventional skid steer attachments to be used on vehicles having an extension such as tractors, backhoes and excavators. The present invention also comprises the combination of the vehicle having an extension and the adaptor faceplate wherein the adaptor faceplate comprises a rigid member securable to skid steer attachments with the rigid member having a front side, a back side, and a set of connecting members positioned on the back side of the rigid member. The set of connecting members are connectable to a first extension mount and a second extension mount located on an end of the extension of the vehicles.

Figure 1:
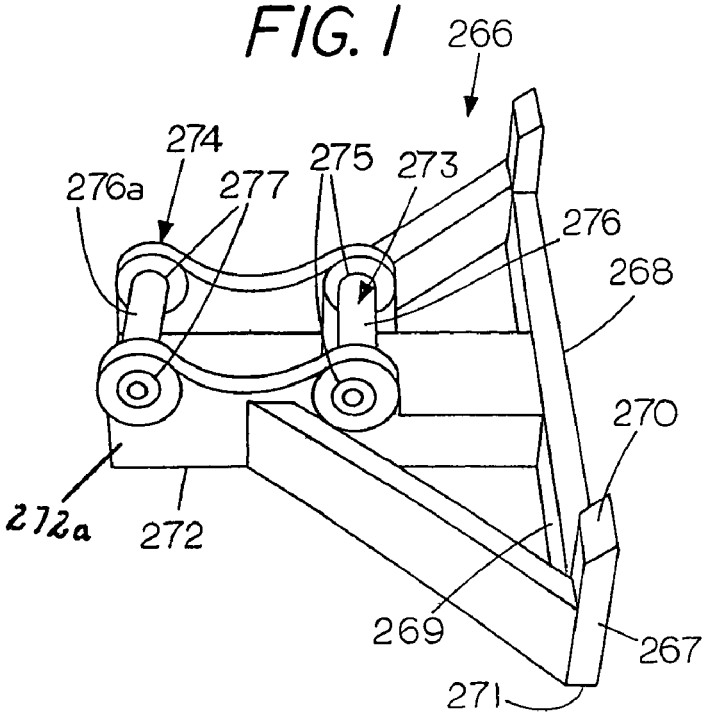
FIG. 1 is a perspective view showing an embodiment of an adaptor faceplate.
Figure 2:
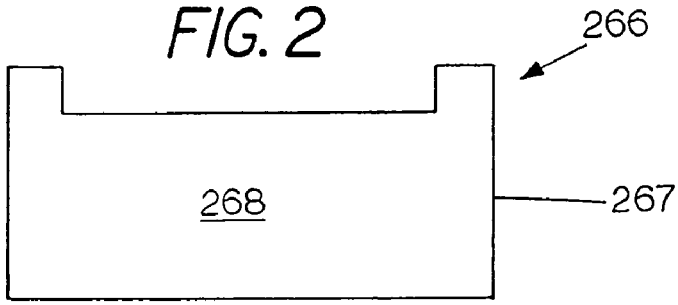
FIG. 2 shows a front view of the adaptor faceplate of FIG. 1.
Figure 3:
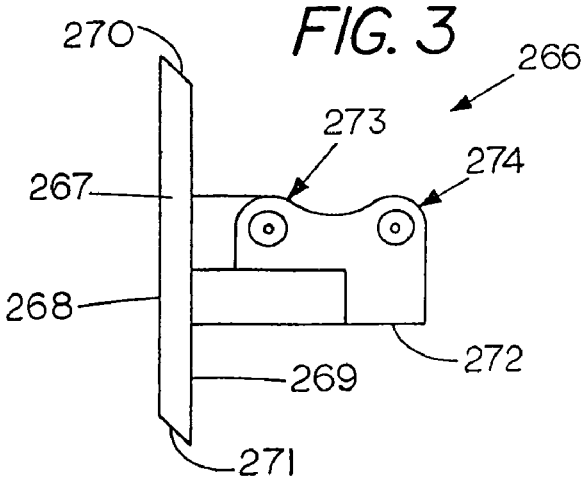
FIG. 3 shows a side view of the adaptor faceplate of FIG. 1.

Referring to FIGS. 1, 2, and 3, FIG. 1 shows a perspective view, FIG. 2 shows a front view, and FIG. 3 shows a side view of an embodiment of an adaptor faceplate 266 of the present invention. Adaptor faceplate 266 comprises a rectangular shaped rigid member 267 securable to conventional skid steer attachments. Rigid member 267 includes a front side 268, a back side 269, an angled top lip 270 to form mating engagement with the conventional skid steer attachments and a bottom angled lip 271 that engages a locking mechanism, such as the mechanism shown in FIGS. 10 and 11, to hold a skid steer attachment in a working relationship on rigid member 267.

Positioned on the back side 269 of the rigid member 267 is a first connecting member 273 and a second connecting member 274, which functions to attach adaptor faceplate 266 to an extension of vehicles such as tractors, backhoes and excavators. Although the connecting members of the present invention can comprise a plurality of attachment devices including but not limited to clasp, bolts, pins, and hooks, the first connecting members 273 comprises an elongated cylindrical bar or pivot pin 276 supported in a first set of openings 275 in frame 272 and elongated cylindrical bar or pivot pin 276*a* supported in a second set of openings 277 in frame 272.

Figure 14:
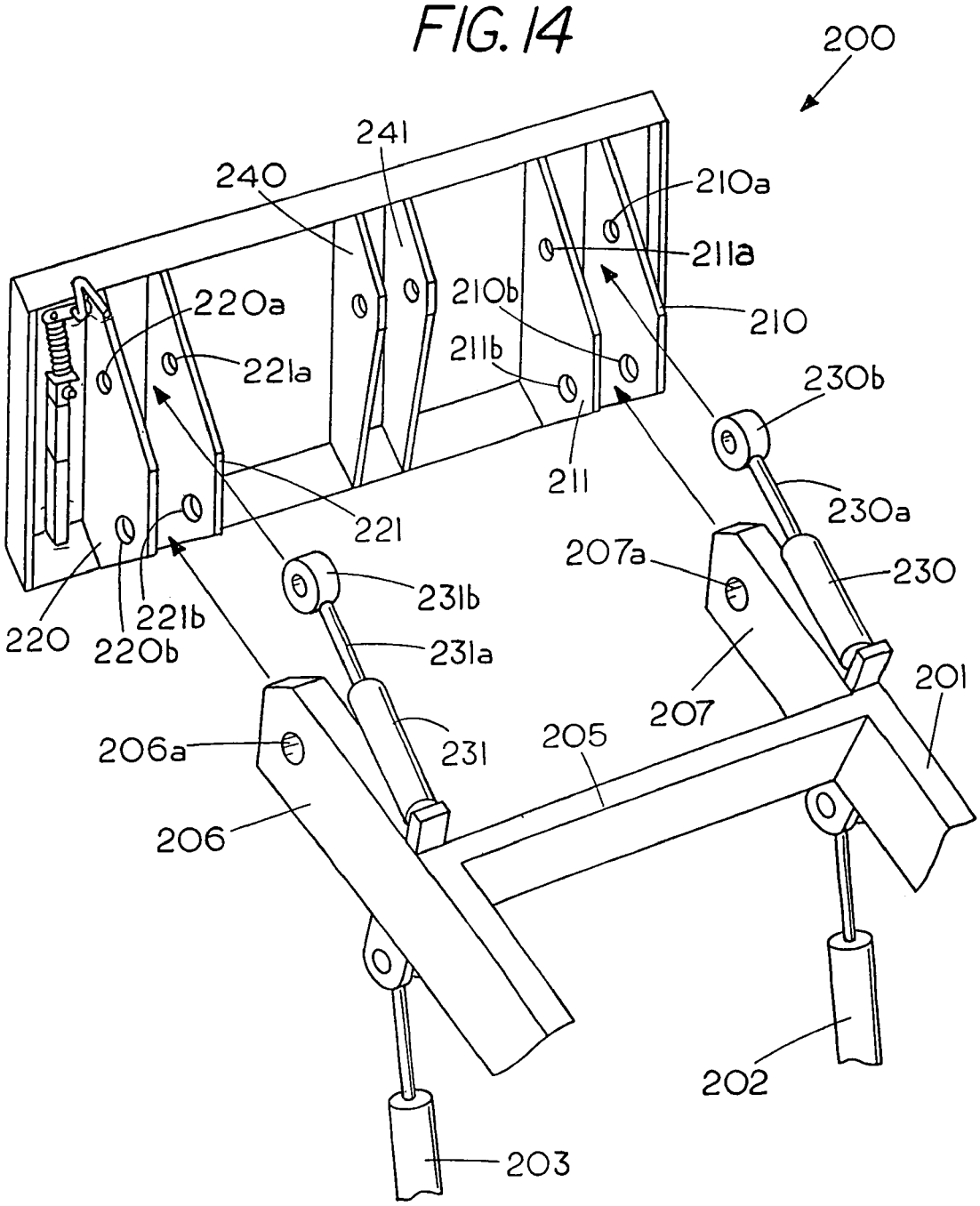
FIG. 14 is a perspective view of a faceplate for attachment to the front end of tractor loader.

Referring to FIG. 14, it is noted that adaptor faceplate 266 is similar to the faceplate 200 shown in FIG. 14. Adapter face place 200 also uses pivot pins to connect the adaptor plate to a fixed tractor extension (extensions 207 and 206) and to a source of hydraulic power (hydraulic cylinders 230 and 231) enabling the use of tractor hydraulic power to allow one to manipulate faceplate 200 from the seat of a tractor. Similarly, adapter faceplate 266 uses pivot pins 272 and 273 to connect the adaptor plate 266 to a fixed tractor extension and a source of hydraulic power also enabling the use of tractor hydraulic power to provide manipulation of faceplate 200 from the seat of a tractor. Thus adaptor faceplate 266 and adapter faceplate 200 are both securable to a tractor through an extension and an extendible arm enabling the use of hydraulic power from a tractor to provide manipulation of faceplate 200. While faceplate 200 uses four pivot pins faceplate 266 uses two pivot pins comprising elongated cylindrical bars 276 and 276*a* that are extendable through two set of openings 275 and 277 located on the back side 269 of adaptor faceplate 266 for connecting adaptor faceplate 266 to the power-operated extension. Stability of the connection of adaptor faceplate 266 to the power-operated extension is obtained by the size and elongated shape of cylindrical bar or pivot pins 276 and 276*a* along with the positioning of set of openings 275 and 277 proximal a midpoint between the ends of the rigid member 268 of adaptor faceplate 266.

In the embodiment of adaptor faceplate 266 of FIGS. 1, 2, and 3, the first and second connecting members 273 and 274 are shown supported on an elongated center member 272*a* of frame 272 extending from the back side 269 of rigid member 267. In further regards to the connecting member of the present invention, although adaptor faceplate 266 is shown in FIGS. 1 and 3 as having two connecting member 273 and 274, alternative embodiments of the present invention can include adaptor faceplates having more than two connecting members.

Figure 4:
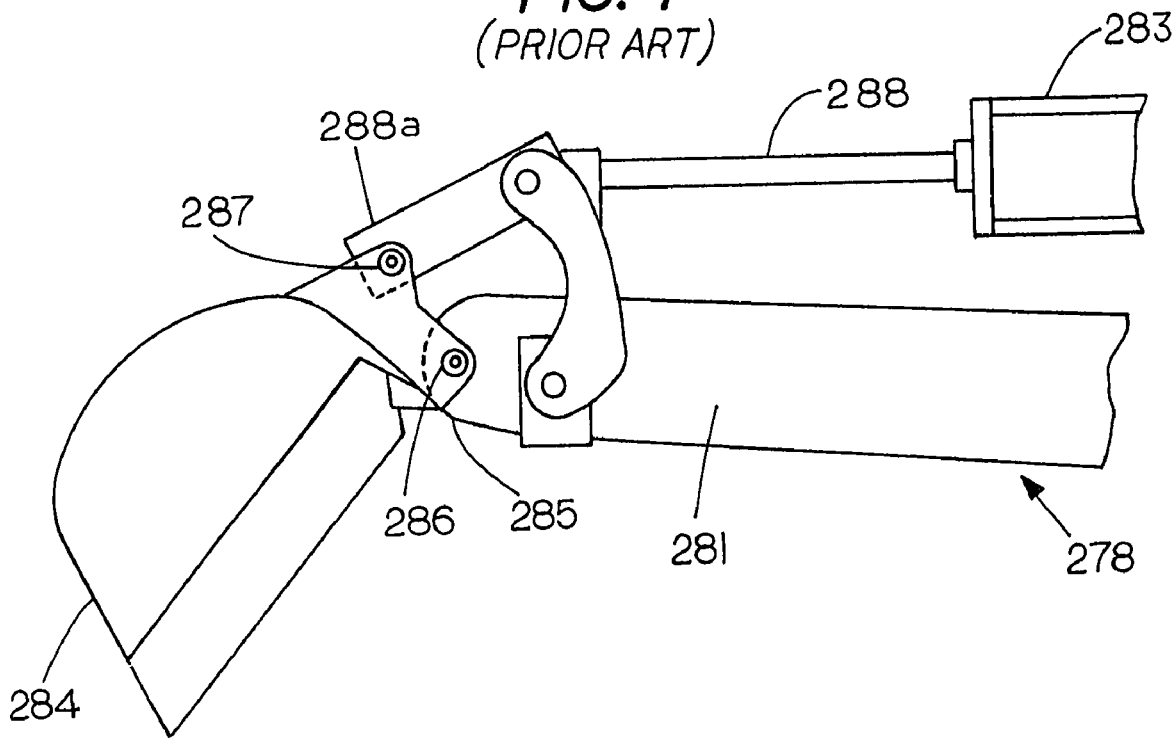
FIG. 4 (PRIOR ART)
FIG. 4 shows a partial side view of a power-operated boom of a conventional backhoe tractor or excavator.
Figure 7:
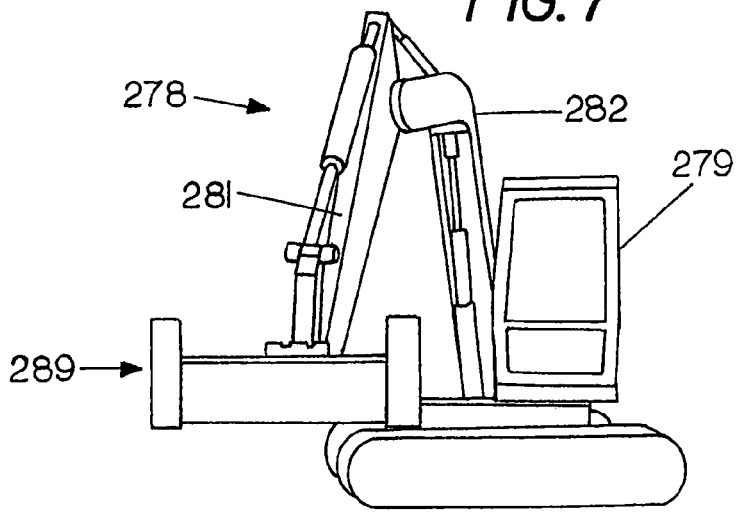
FIG. 7 is a perspective view showing a conventional excavator having the adaptor faceplate of FIG. 5 attached to the power-operated boom of the excavator.
Figure 8:
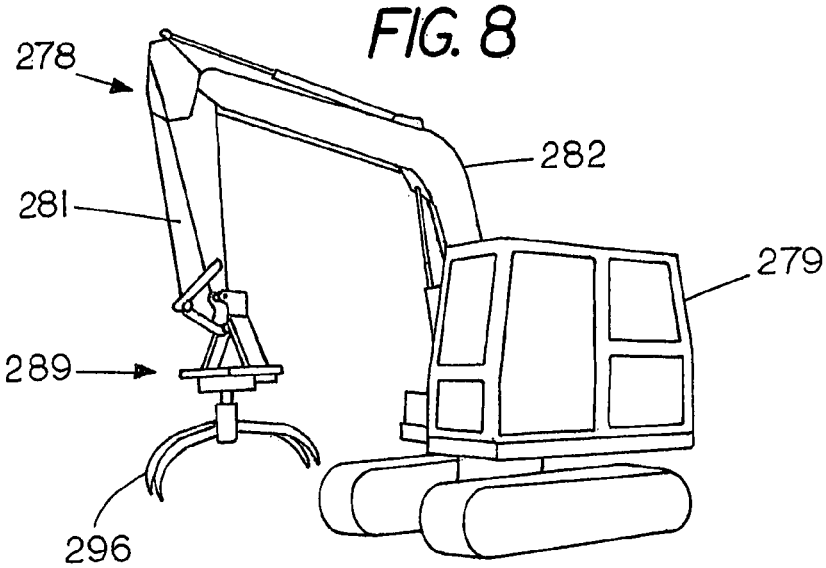
FIG. 8 is a perspective view showing the excavator of FIG. 7 and a grapple hook attached to the adaptor faceplate of FIG. 5.
Figure 8A:
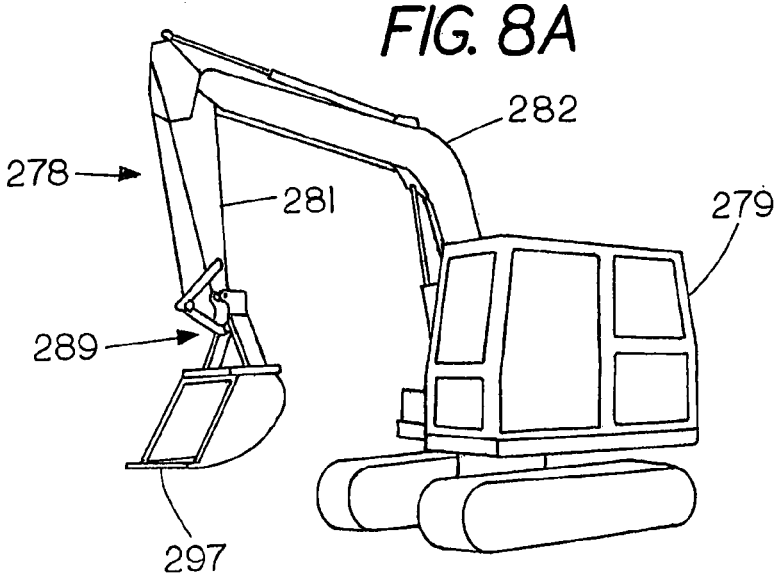
FIG. 8A is a perspective view showing the excavator of FIG. 7 having a skid steer attachment comprising a skid steer bucket attached to the adaptor faceplate.

FIG. 4 shows a partial side view of a prior art power-operated tractor extension comprising a power-operated boom 278 used on a conventional backhoe tractor or excavator to manipulate a scoop or bucket 284 that is directly connected to the extensions 281 and 288*a*. An excavator 279 with an adapter faceplate of the present invention is shown in FIGS. 7, 8, and 8A. Since the power-operated boom 278 of backhoe tractor 280 and excavator 279 generally comprises similar parts, the power-operated boom 278 of backhoe tractor 280 and excavator 279 will hereinafter be described using the same reference numerals.

Referring to FIGS. 7, 8, 8A, 9, and 9A, power-operated boom 278 of excavator 279 and backhoe tractor 280 generally comprises a first arm 281 and a second arm 282. The second arm 282 of the boom 278 is pivotally attached to the vehicles 279, 280 and is design to be raised or lowered as part of the operation of the vehicles 279, 280. The first arm 281 of boom 278 is pivotally attached to the second arm 282 of the boom 278 and generally includes a hydraulic cylinder 283 for providing pivoting movement to a conventional backhoe or excavator scoop 284 (FIG. 4). More specifically, as shown in FIG. 4, the first arm 281 of power-operated boom 278 includes an end 285 pivotally connected to a first attachment site 286 on the scoop 284. The hydraulic cylinder 283 of first arm 281 includes a moveable arm 288 having an end 288*a* pivotally connected to a second attachment site 287 on scoop 284 wherein the extension or contraction of the moveable arm 288 of the hydraulic cylinder 283 provides for pivotal movement of scoop 284.

Figure 5:
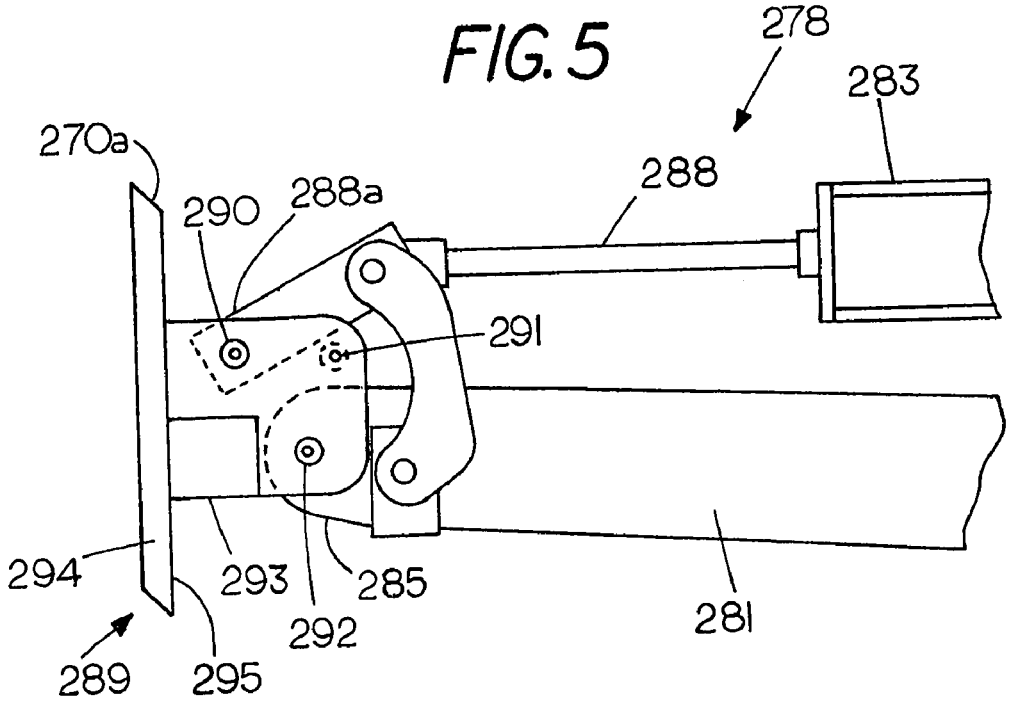
FIG. 5 shows the power-operated boom of FIG. 4 with the backhoe or excavator scoop replaced with an adaptor faceplate.

FIG. 5 shows power-operated boom 278 with backhoe or excavator scoop 284 replaced with an adaptor faceplate 289 of the present invention. Adaptor faceplate 289 comprises similar components as adaptor faceplate 266 of FIGS. 1-3. However, adaptor faceplate 289 is shown in FIG. 5 having a first connecting member 290, a second connecting member 291, and a third connecting member 292 supported on a frame 293 extending from a back side 295 of rigid member 294. It is noted that connecting members 290 and 291 are identical to connecting members 273 and 274 of the adapter faceplate 266 shown in FIG. 1 and third connecting member 292 is similar to connecting members 273 and 274 of the adapter faceplate 266 but is support at a different location on frame 293 of adapter faceplate 289.

As shown in FIG. 5, in the attachment of adaptor faceplate 289 to power-operated boom 278, the end 285 of first arm 281 is pivotally connected to the third connecting member 292 of adaptor faceplate 289. In addition, the end 288*a* of moveable arm 288 of hydraulic cylinder 283 is pivotally connected to the first connecting member 290 of adaptor faceplate 289 wherein the extension or contraction of the moveable arm 288 of the hydraulic cylinder 283 provides for pivotal movement of adaptor faceplate 289. More specifically, the moveable arm 288 of hydraulic cylinder 283 allows one to manipulate the adaptor faceplate 289 to move a top lip 270*a* of adaptor faceplate 289 back and forth to enable one to engage the lip 270*a* with a skid steer attachment without having to move the excavator 279 or backhoe 280 or the arms 281, 282 of the boom 278 of the excavator 279 and backhoe 280.

It is noted that providing adaptor faceplate 289 with an additional connecting member 292 compared to the adapter faceplate 266 shown in FIG. 1 increases the types of skid steer attachment that can be used with power-operated boom 278. That is, connecting the end 285 of first arm 281 to the third connecting members 292 provides a greater range of motion to adaptor faceplate 289 and in turn the skid steer attachment that is secured to adaptor faceplate 289 compared to the connection of the end 285 of first arm 281 to the second connecting members 291 thereby allowing power-operated boom 278 to be used with skid steer attachments that require greater or different range of motion.

Figure 6:
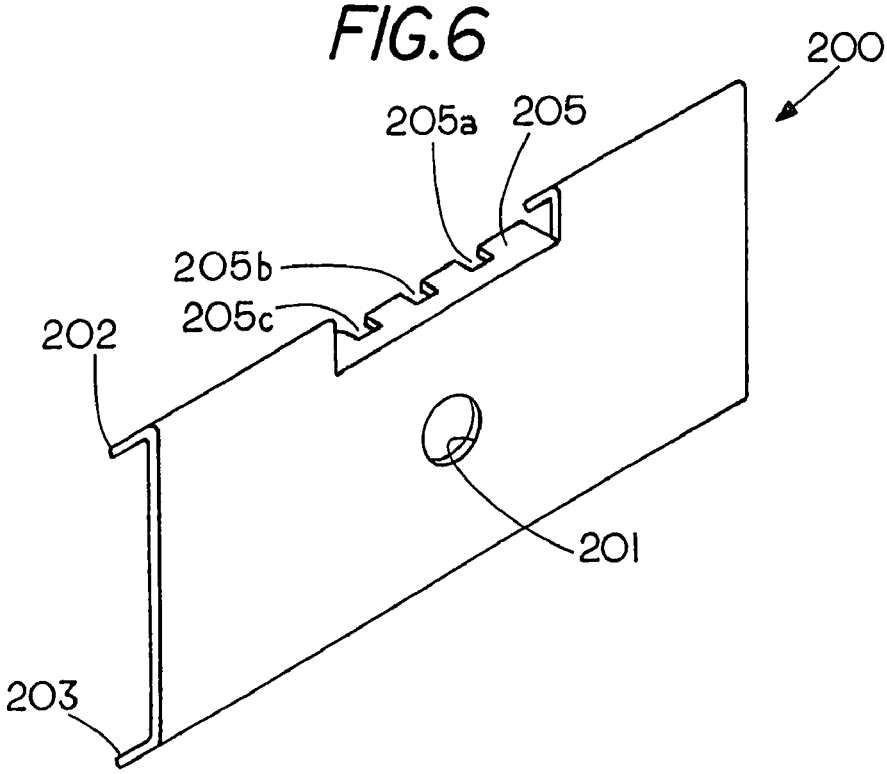
FIG. 6 shows a perspective view of a faceplate with the chain latch and a housing that permits rotation of a tool without removal of the tool.

FIG. 6 is a perspective of a faceplate 200 having a cylindrical housing 201 for receiving and rotationally journaling with a tool such as a grapple hook or the like. The journal attachment allows one to rotate the tool to enable attachment of the tool at any of a number of different angular orientations. The faceplate 200 has an upper triangular lip 202 and a lower triangular lip 203 for engaging with an attachment for a skid steer. Located on the top portion of faceplate 200 is a chain latch member 205 having a set of spaced apart chain link slots 205*a*, 205*b* and 205*c* therein. The chain latch member extends in a direction generally normal to front face the faceplate 200 to provide enhanced support for a chain positioned therein.

Figure 6A:
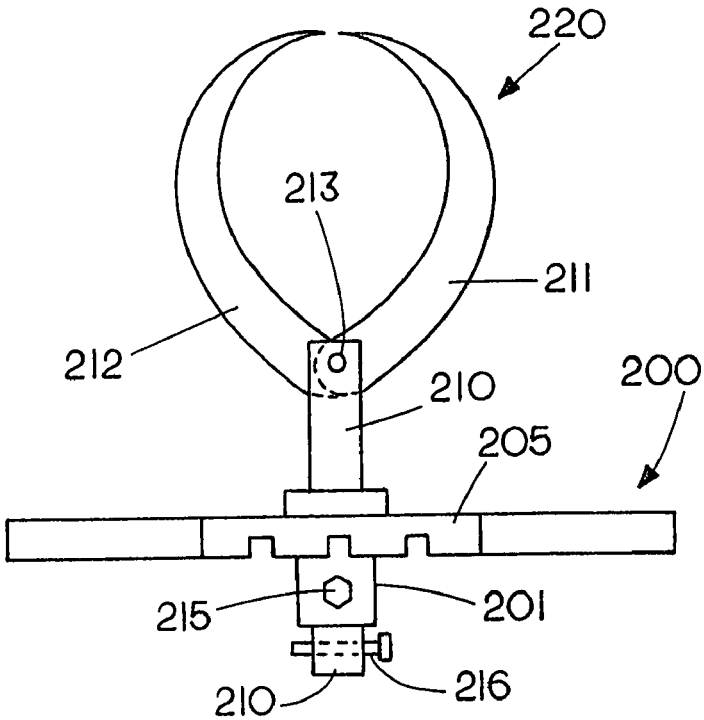
FIG. 6A is a top view showing a grapple hook tool with the grapple hook extending in a normal direction from the faceplate.

FIG. 6A shows a top view of faceplate 200 with the tool comprising a grapple hook 220 mounted in the housing 201 on faceplate 200. Housing 201 has a generally circular opening to permit a journeyed insertion of the circular shaft 210 of grapple hook 220 into the housing. A first pin 216 extends through a hole in shaft 210 to axial restraint shaft 210 but permit rotation of shaft 210 about its axis. That is the pin 216 and the flange 218 restrain shaft 210 from axial displacement but permit rotation within the housing 201 since pin 216 is located outside of housing 201. To prevent rotation of shaft 210 the housing 201 includes a set of holes so that a pin 215 can be extended diametrically through both the housing 201 and the shaft 210 to prevent rotation of the shaft 210 with respect to housing 201.

In certain applications it may be necessary for on-the-go rotation of the tool to a different orientation. If the tool is heavy or bulky one does not want to remove and reinsert the tool at a different position. By having the shaft 210 circular and slightly smaller than the circular opening in the housing 201 one creates a journaled relationship that allows one to rotate the shaft 210 to the desired orientation by temporarily removing pin 215. While the shaft and housing are shown being mechanically pinned to prevent rotation one could provide for hydraulic operation of the system. That is, if desired one can maintain the angular orientation of the tool in the housing 201 with a hydraulic cylinder or one could change the angular orientation with a hydraulic cylinder or other power device.

Referring to FIGS. 7, 8, and 8A, FIG. 7 is a perspective view showing a conventional excavator 279 with adaptor faceplate 289 attached to the power-operated boom 278 of the excavator 279. FIG. 8 is a perspective view showing the excavator 279 of FIG. 7 with a grapple hook 296 attached to adaptor faceplate 289. FIG. 8A is a perspective view showing the excavator 279 of FIG. 7 with a skid steer attachment comprising a skid steer bucket 297 attached to adaptor faceplate 289.

Figure 9:
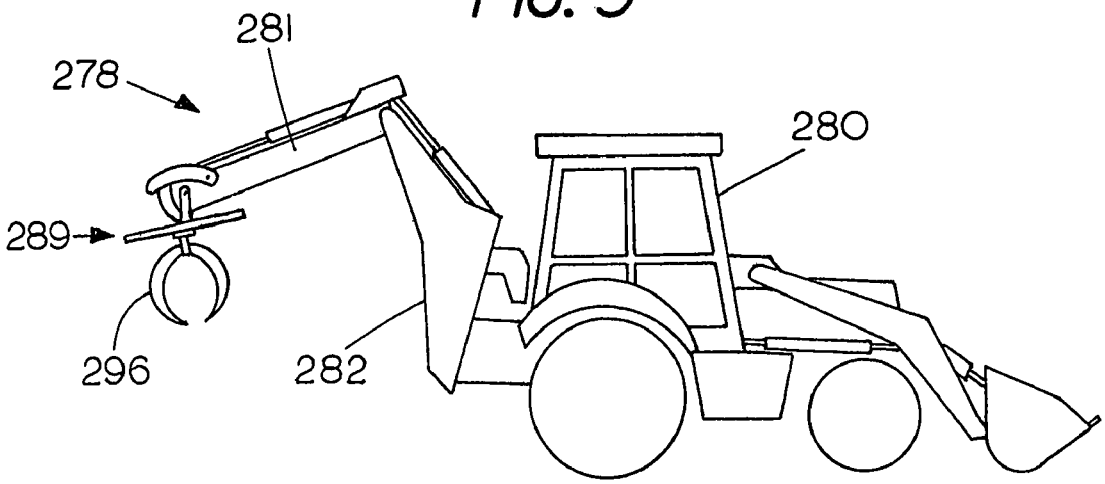
FIG. 9 is a side view showing a backhoe tractor having the adaptor faceplate attached to the boom and the grapple hook attached the adaptor faceplate.
Figure 9A:
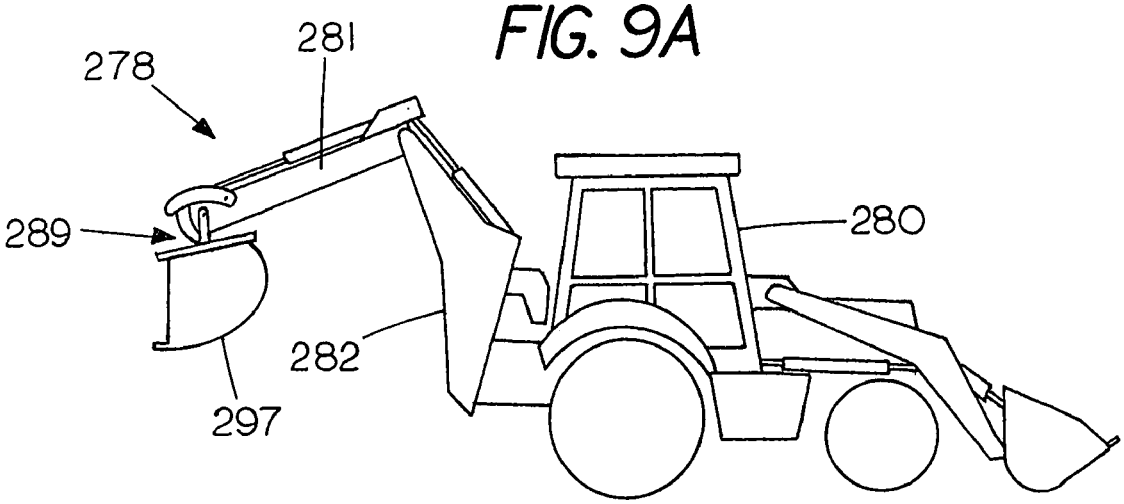
FIG. 9A is a side view showing the backhoe tractor having the adaptor faceplate attached to the boom and the skid steer bucket attached to the adaptor faceplate.

Referring to FIGS. 9 and 9A, FIG. 9 is a side view showing conventional backhoe tractor 280 having adaptor faceplate 289 attached to the power-operated boom 278 of the backhoe tractor 280. FIG. 9 shows a grapple hook 296 attached the adaptor faceplate 289. FIG. 9A is a side view showing backhoe tractor 280 having adaptor faceplate 289 attached to the power-operated boom 278 of the backhoe tractor 280 with skid steer bucket 297 attached to adaptor faceplate 289.

Figure 10:
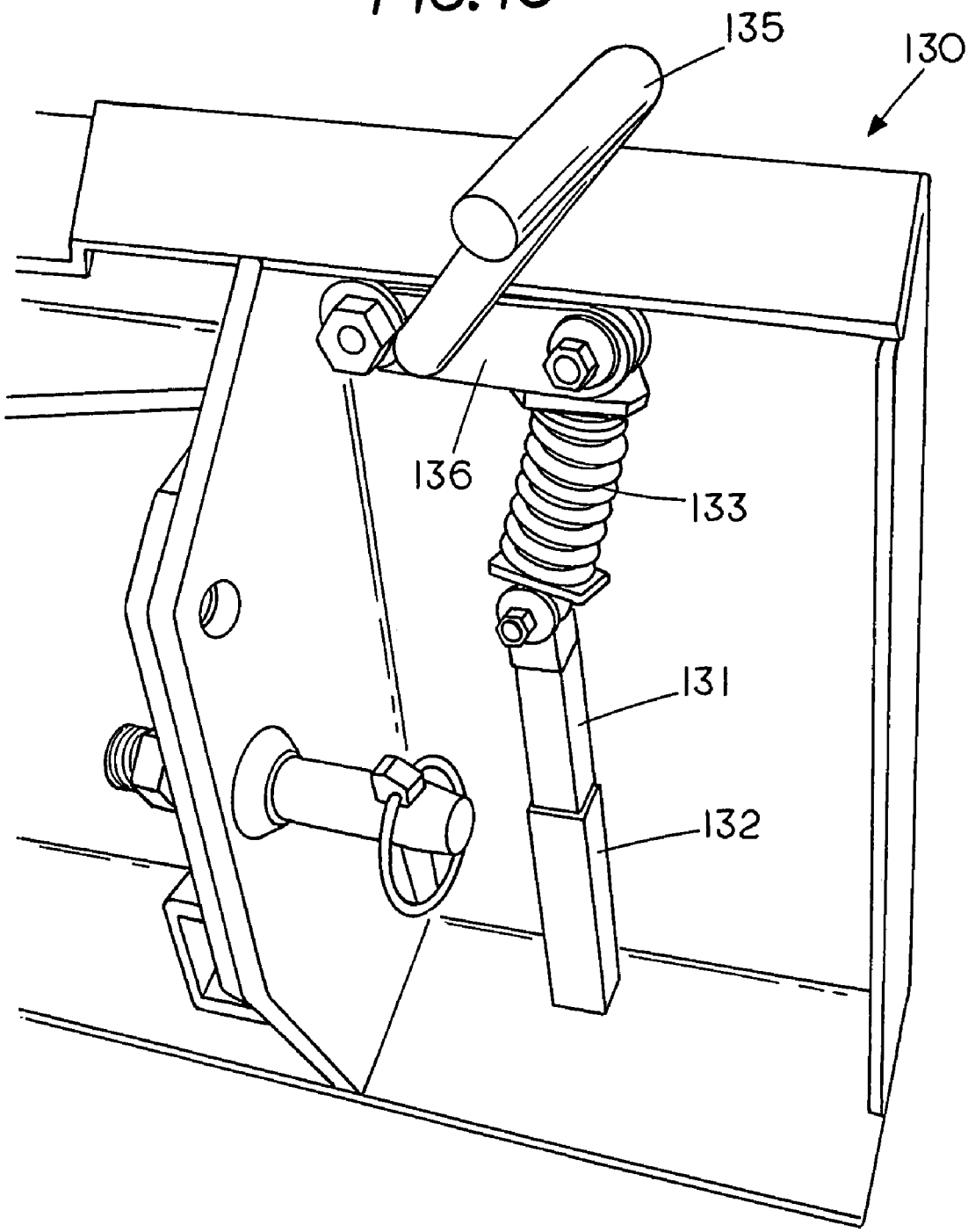
FIG. 10 shows a locking device for locking a skid steer attachment to a three-point hitch faceplate or the adaptor faceplate.

FIG. 10 shows a locking device 130 for locking a skid steer attachment to a three-point hitch faceplate or to the adaptor faceplate of the present invention in an unlocked condition. The mechanism includes a member 131 that slidingly extends in housing 132 and can be retracted or extended therein by partial rotation of handle 135 which rotates link 136 to compress spring 133 and force member 131 downward and through housing 132.

Figure 11:
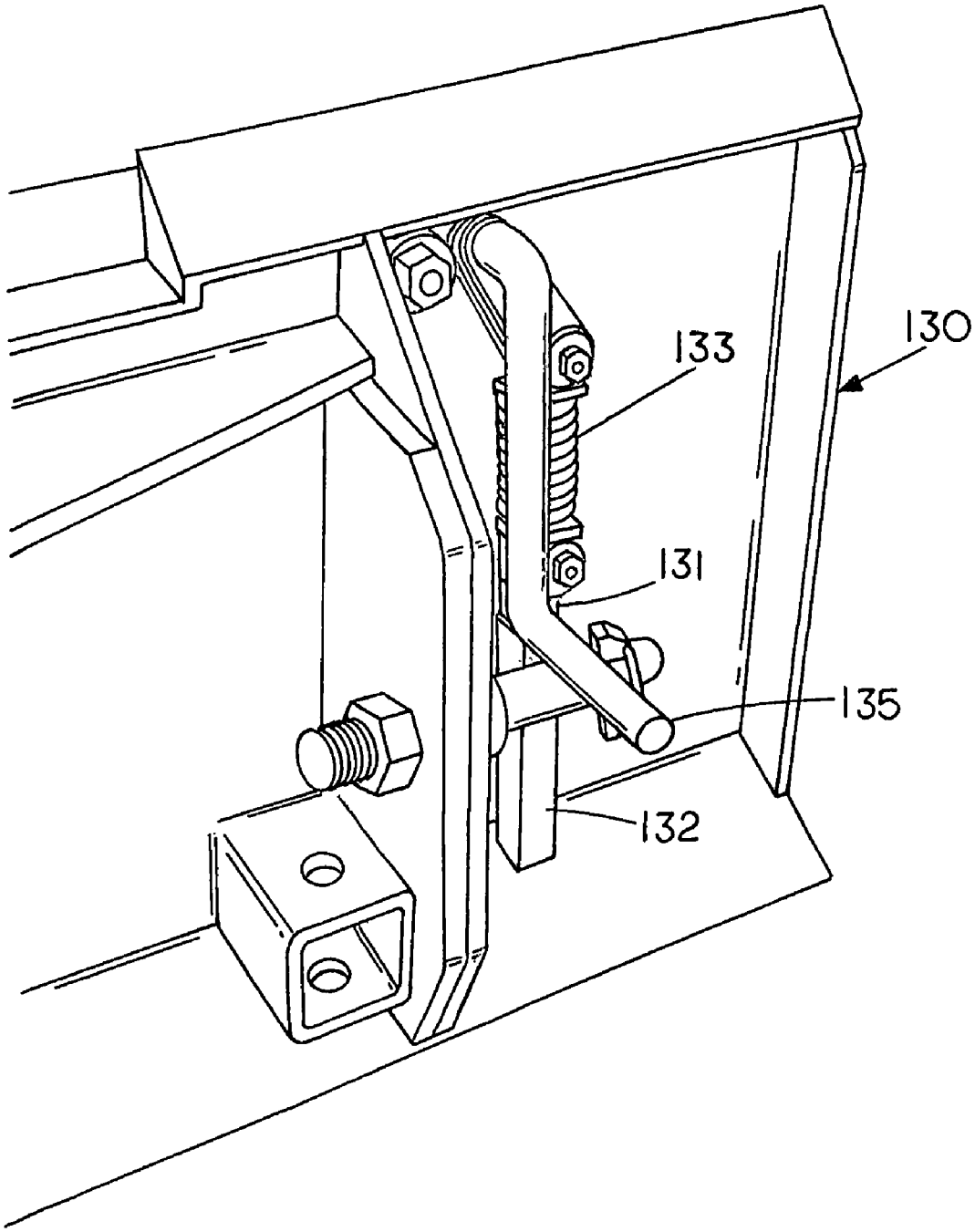
FIG. 11 shows the locking device of FIG. 10 in a locked condition to secure an attachment to the three-point hitch faceplate or the adaptor faceplate.

FIG. 11 shows the locking device of FIG. 10 in a locked condition to secure an attachment to the three-point hitch faceplate or adaptor faceplate of the present invention. In the locked condition the member 131 is extended into housing 132 which cause the member 131 to extend outward of the bottom of the faceplate (not shown) as the lever 135 is rotated clockwise to compress spring 133.

The use of locking mechanism on both side of the faceplate holds the bottom of the skid steer attachment securely against the three-point hitch faceplate and the adaptor faceplate and keeps the attachment from slipping at the bottom and also keeps the top of the attachment against a top retainer bar located on top of the three-point hitch faceplate and the adaptor faceplate. The lever-operated mechanism is hingedly attached to the three-point hitch faceplate and the adaptor faceplate on the top to permit engagement or disengagement of an attachment to the three-point hitch faceplate and the adaptor faceplate. As an alternate embodiment one could have an extension to permit an operator to lock or unlock the mechanism from the seat of the tractor. Also a hydraulic or relay type mechanism could be used to lock or unlock a skid steer attachment to the three-point hitch faceplate and the adaptor faceplate.

While the adaptor faceplate 289 has been described secured to the power-operated boom of the excavator 279 and backhoe tractor 280, the adaptor faceplate could be also secured to a front-end loader and could also be configured to other vehicles such as trucks or other utility vehicles.

Figure 12:
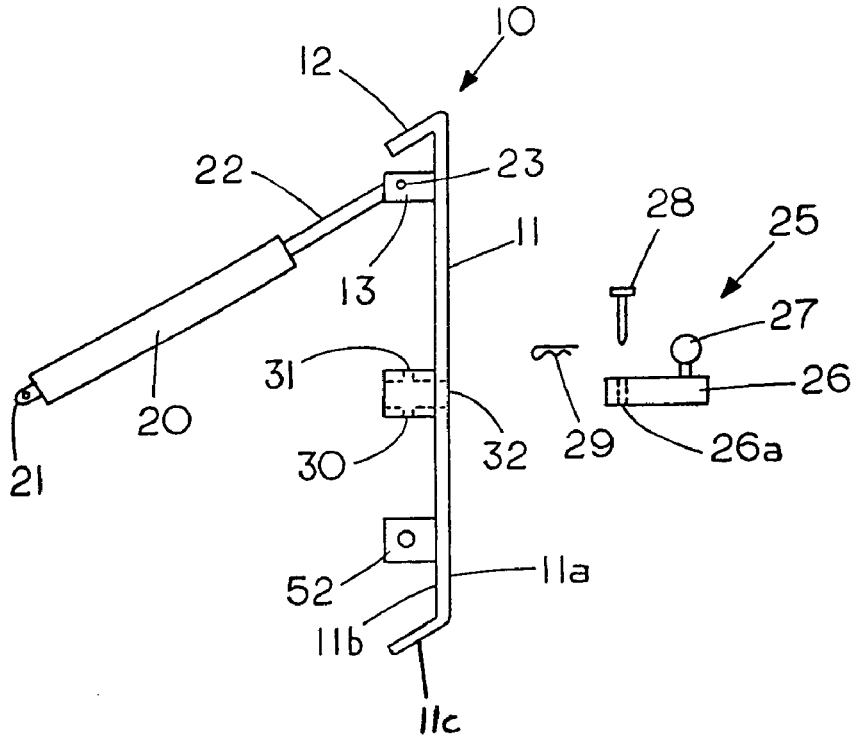
FIG. 12 is a side view of my three-point hitch faceplate.

FIG. 12 shows a side view of a three-point hitch faceplate 10. Similar to adaptor faceplate 266 and 279, three-point hitch faceplate 10 comprises a rigid rectangular shaped member 11 having a front face 11*a*, a rear face 11*b* and a rearward extending top lip 12 to form mating engagement with a conventional skid steer attachment and a bottom angled lip 11*c*that engages a locking mechanism to hold an attachment on the three-point hitch faceplate 10. Mounted on the rear face 11*b*of faceplate 11 is a first connecting member 52 and a second connecting member (not shown) with the first connecting member 52 and the second connecting member laterally spaced from each other and secured to the backside 11*b*of rigid member 11. The first connecting member 52 is connectable to a first tractor mount (not shown) through a pin (not shown) and the second connecting member is connectable to a second tractor mount (not shown) through a pin (not shown). A third connecting member 13 is secured to the back side 11*b*of rigid member 11 with the third connecting member spaced from a straight line connecting the first connecting member 52 and second connecting member 52 to thereby form a portion of a three-point engagement with the rigid plate 11.

In the present embodiment a two way hydraulic cylinder 20, which is extendible and contractible, has a first end 21 for connecting to third tractor mount and a second end 22, pivotally connected to the third connecting member 13 to thereby form an extendible link between the third tractor mount (not shown) and the third connecting member 13 to allow a user to position the rigid member 11 for attachment to a skid steer attachment.

The use of an extendible link, in this case a hydraulic cylinder, allows one to move the top lip 12 back and forth to enable one to engage the lip 12 with a skid steer attachment without having to move the tractor. Thus the hydraulic cylinder 20 allows one to provide additional motion to the conventional motion of a three-point hitch. As a result an operator can manipulate the three-point hitch faceplate 10 to enable one to pick up and engage skid steer attachment. A set of spaced apart openings 38 and 39 are positioned in member 11 so as to allow skid steer attachment links (not shown) to penetrate through the rigid member 11 so that the skid steer attachment can be locked on the faceplate 10 by extending a pin through the links. Although pin fasteners are shown, other means of locking the attachment to the three-point hitch faceplate can be used.

Figure 13:
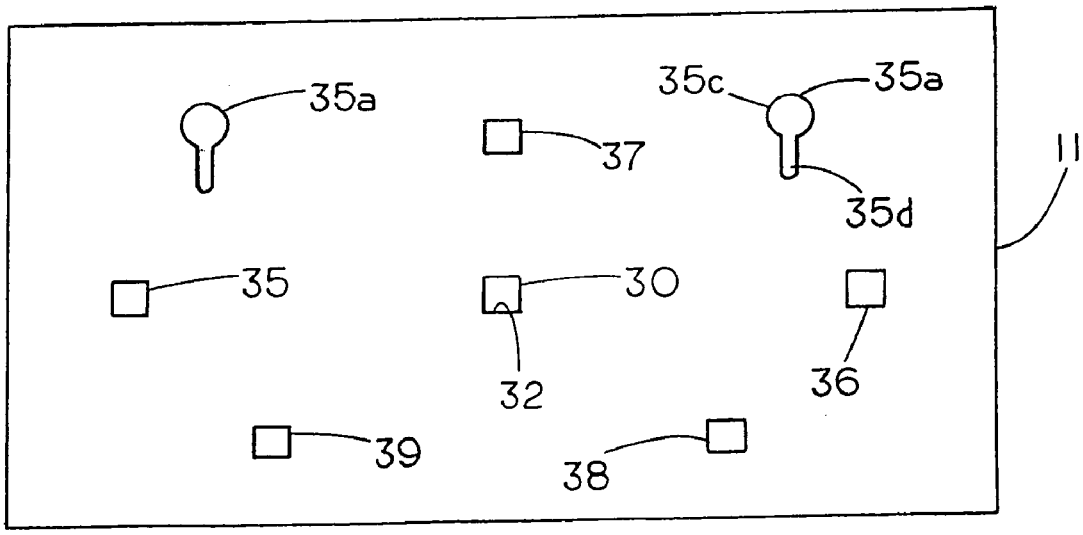
FIG. 13 is a front view of the three-point hitch faceplate of FIG. 12.

The embodiment shown in FIGS. 12 and 13 allows one to use a conventional agricultural tractor with a three-point tractor mount to operate skid steer attachments and it also allows an operator to use the three-point hitch faceplate 11 for securement of a trailer hitch or a drawbar.

FIG. 13 shows a front view of rigid member 11 having a first box member 32, a second box member 35, a third box member 36 and a fourth box member 37 which are secured to plate 11 through welding or the like. Each of the box members can receive a conventional ball hitch or receiver hitch, which can be temporarily secured thereto to enable the tractor to be used for towing.

FIG. 12 shows the ball hitch 25 includes a member 26 for mating insertion with any of the box members. Member 26 includes a through hole 26*a* that allows one to insert pin 28 there through and latch the pin with key 29. For example, member 26 is inserted into box member 30 and the holes 26*a* and 31 are aligned and the pin 28 is inserted thereto and latched with key 29 to maintain the trailer hitch 25 in position. The operator can now use ball 27 on the ball hitch 25 to move a towable vehicle from one location to another.

FIG. 14 shows a partial perspective view of an alternate embodiment of my three-point hitch faceplate for use on either the front end of a tractor or the rear of a tractor. Faceplate 200 includes a set of vertical flanges 220, 221, 210 and 211. Flange 210 has a set of openings 210*a* and 210*b* and flange 211 has a set of laterally aligned openings 211*a* and 211*b*. Similarly, flange 221 has a set of openings 221*a* and 221*b* and flange 220 has a set of laterally aligned openings 220*a* and 220*b*.

A portion of the front-end loader 201 is shown with a hydraulic cylinder 202 and a hydraulic cylinder 203 for lifting and lower front-end loader 201. Located on one side of loader 201 is an extension 207 having an opening 207*a* that can be aligned with openings 210*b* and 211*b* to enable a pivot pin or connecting member (not shown) to be extended therethrough. Similarly, on the other side of loader 201 is an extension 206 having an opening 206*a* that can be aligned with openings 220*b* and 221*b* to enable a pivot pin or connecting member (not shown) to be extended therethrough. A cross member 205 separates and holds extensions 206 and 207 in position. The pivotal connections of extensions to the faceplate 200 allows faceplate 200 to pivot with respect to an axis through the openings 206*a* in the arm 206 and the opening 207*a* in arm 207.

Located on top of extension 207 is a first two way hydraulic cylinder 230 having an extension arm 230*a* and an eye end 230*b* for alignment with the opening 210*a* and 211*a* to enable a pivot pin or connecting member (not shown) to be extended therethrough to form a pivoting connection to the faceplate flanges. Similarly, located on top of extension 206 is a two way hydraulic cylinder 231 having an extension arm 231*a* and an eye end 231*b* for alignment with the opening 220*a* and 221*a* to enable a pivot pin or connecting member (not shown) to be extended therethrough to form a pivoting connection to the faceplate flanges. This feature allows my faceplate to be pivotally attached to the front end of a tractor loader.

A central flange 240 and 241 are included to enable one to use a tractor loader with a single hydraulic cylinder in instead of the two lateral cylinders 230 and 231. In addition, one can mount the three-point hitch faceplate 200 on the three-point hitch of a tractor using the central flanges 240 and 241. Thus a feature of the embodiment of FIG. 14 is that the faceplate 200 is a universal faceplate that can be mounted on either the front or rear of a tractor.

We claim:

1. An adaptor faceplate comprising:

a conventional skid steer attachment;

a rigid member securable to said conventional skid steer attachment, said rigid member having a front side and a back side;

a first connecting member and a second connecting member positioned on the back side of said rigid member, said first and second connecting members connectable to a first extension mount and a second power-operated extension mount; and a frame extending from said back side of said rigid member, said frame including an elongated center member extending lengthwise from said back side of said rigid member and supporting said first connecting member thereon and said second connecting member thereon a further distance rearward from said first connecting member.

2. The adaptor faceplate of claim 1 wherein said conventional skid steer attachment comprises a conventional skid steer bucket.

3. The adaptor faceplate of claim 1 wherein said rigid member includes an angled top lip to form mating engagement with said conventional skid steer attachment.

4. The adaptor faceplate of claim 1 wherein said rigid member includes a housing located in said rigid member, said housing having a cylindrical opening for rotationally mounting a tool shaft therein.

5. The adaptor faceplate of claim 4 wherein said tool shaft comprises a shaft of a grapple hook.

6. The adaptor faceplate of claim 1 including a latch mechanism for securing said skid steer attachment to said rigid member.

7. In combination:

a backhoe tractor having an extension; and an adaptor faceplate comprising a rigid member securable to a skid steer attachment, said rigid member having a front side and a back side, said rigid member including a frame extending from said back side of said rigid member, said frame including an elongated center member extending lengthwise from said back side of said rigid member and supporting said first connecting member thereon and said second connecting member thereon a further distance rearward from said first connecting member, said first connecting member and said second connecting member attachable to said extension of said backhoe to permit manipulation of said adapter faceplate by said extension.

8. The combination of claim 7 wherein said extension comprises a power-operated boom with said first connecting member of said rigid member attachable to a moveable arm of a hydraulic cylinder of said power-operated boom and said second connecting member of said rigid member attachable to an arm of said power-operated boom.

9. The combination of claim 7 wherein said skid steer attachment comprises a conventional skid steer bucket.

10. The combination of claim 7 including a housing located in said rigid member, said housing having a cylindrical opening for rotationally mounting a tool shaft therein.

11. The combination of claim 7 including a latch mechanism for securing said skid steer attachment to said rigid member.

12. In combination:

a vehicle having an extension having a first power-operated extension mount and a second extension mount; and an adaptor faceplate comprising a rigid member securable to skid steer attachments, said rigid member having a front side and a back side, said rigid member including a frame extending from said back side of said rigid member, said frame including an elongated center member a frame extending from said back side of said rigid member, said frame including an elongated center member extending lengthwise from said back side of said rigid member and supporting said first connecting member thereon and said second connecting member thereon a further distance rearward from said first connecting member, said first connecting member attachable to said first power-operated extension mount and said second connecting member attachable to said second extension mount.

13. The combination of claim 12 wherein said vehicle having said extension comprises a backhoe tractor having a power-operated boom.

14. The combination of claim 12 wherein said vehicle having said extension comprises an excavator having a power-operated boom.

15. The combination of claim 12 including a latch mechanism for securing said skid steer attachments to said rigid member.

16. The combination of claim 12 including at least a third connecting member supported on said elongated center member of said frame for attachment to said first power-operated extension mount or said second extension mount.

17. The combination of claim 12 wherein said rigid member includes an angled top lip to form mating engagement with said skid steer attachment.

18. The combination of claim 17 including a latch mechanism for securing said skid steer attachments to said rigid member.

* * * * *

UNITED STATES PATENT AND TRADEMARK OFFICE

CERTIFICATE OF CORRECTION

PATENT NO. : 7,648,326 B2
APPLICATION NO. : 11/709344
DATED : January 19, 2010
INVENTOR(S) : Christopher Santele et al.

It is certified that error appears in the above-identified patent and that said Letters Patent is hereby corrected as shown below:

In the Specification

Column 1, lines 6-13 should read

Cross Reference to Related Applications

This application is a continuation in part of ~~claims priority to currently pending~~ U.S. patent application Ser. No. 10/877,272; filed on Jun. 25, 2004 and titled FACEPLATE now U.S. patent 7,226,268; which is a continuation in part of U.S. patent application Ser. No. 10/440,649, now U.S. Pat. No. 7,108,475, filed on May 19, 2003 and titled THREE-POINT HITCH FACEPLATE, ~~and~~ which claims priority from U.S. Provisional Application No. 60/437,076, filed Dec. 30, 2002 ~~and titled and~~ titled THREE-POINT HITCH FACE PLATE.

Signed and Sealed this
Eighteenth Day of February, 2014

Michelle K. Lee

Michelle K. Lee
*Deputy Director of the United States Patent and Trademark Office*